US005241348A

United States Patent [19]

Garavuso et al.

[11] Patent Number: 5,241,348

[45] Date of Patent: Aug. 31, 1993

[54] FUSING OF COPY SHEETS IN SKEWED ARRANGEMENT IN AN ELECTROPHOTOGRAPHIC APPARATUS

[75] Inventors: Gerald M. Garavuso, Farmington; Michael J. Martin, Rochester, both of N.Y.

[73] Assignee: Xerox Corporation, Stamford, Conn.

[21] Appl. No.: 797,667

[22] Filed: Nov. 25, 1991

[51] Int. Cl.[5] ..... G03G 15/20

[52] U.S. Cl. ..... 355/282; 355/295

[58] Field of Search ..... 355/282, 294, 285, 290, 355/318, 319, 271, 308, 309, 395; 219/216; 271/272-274

[56] References Cited

U.S. PATENT DOCUMENTS

| | | | |
|---|---|---|---|
| 3,856,461 | 12/1974 | Jordan | 432/60 |
| 4,378,152 | 3/1983 | Edwards et al. | 355/285 |
| 4,572,648 | 2/1986 | Toriumi et al. | 355/290 |
| 4,693,587 | 9/1987 | Shigenobu et al. | 219/216 X |
| 4,789,877 | 12/1988 | Izaki | 219/216 X |
| 4,894,687 | 1/1990 | Beaudet | 355/295 X |
| 4,908,633 | 3/1990 | Ohashi et al. | 355/295 X |

FOREIGN PATENT DOCUMENTS

| | | | |
|---|---|---|---|
| 56-60472 | 5/1981 | Japan | 355/282 |
| 60-100164 | 6/1985 | Japan | 355/282 |
| 1-34830 | 2/1989 | Japan | 271/272 |

*Primary Examiner*—R. L. Moses
*Assistant Examiner*—Shuk Y. Lee
*Attorney, Agent, or Firm*—R. Hutter

[57] ABSTRACT

In an electrophotographic printing apparatus having a fuser roll and a second roll forming a nip therebetween for the passage of a copy sheet therethrough, each copy sheet is inserted through the nip so that at least one edge of the copy sheet is skewed relative to the direction of motion of the fuser roll.

2 Claims, 4 Drawing Sheets

FUSING OF COPY SHEETS IN SKEWED ARRANGEMENT IN AN ELECTROPHOTOGRAPHIC APPARATUS

FIELD OF THE INVENTION

The present invention relates to a method of fusing documents in an electrophotographic process. More particularly, the present invention relates to orienting the documents in a skewed fashion as they pass through a fusing station.

BACKGROUND OF THE INVENTION

In the process of xerography, a light image of an original to be copied is typically recorded in the form of a latent electrostatic image upon a photosensitive member. The latent image is then rendered visible by the application of electroscopic marking particles, commonly referred to as toner, to the photosensitive member. The visual image is then transferred from the photosensitive member to a sheet of plain paper with subsequent permanent bonding of the image thereto. This bonding of the toner particles onto the paper generally comprises two steps: fusing, in which the toner particles on the paper are partially melted, or otherwise made fluid; and fixing, in which the fluid toner particles are bonded to the paper. In common parlance, however, these two steps are conceptually combined (since, in many techniques, the two steps occur substantially simultaneously), and the two steps are together known in the art simply as "fusing."

In order to fuse the image formed by the toner onto the paper, electrophotographic printers incorporate a device commonly called a fuser. While the fuser may take many forms, heat or combination hear-pressure fusers are currently most common. One combination heat-pressure fuser includes a heat fusing roll in physical contact with a relatively soft pressure roll. These rolls cooperate to form a fusing nip through which the copy sheet (the sheet on which the document is finally formed) passes.

Fuser rolls are typically in the form of a rotating cylinder, with an outer surface comprising a thin elastomeric layer which contacts the copy material. The outer surface may include a release material, such as the synthetic polymer resin known under the trade name "Teflon," to prevent toner from adhering to the surface of the fuser roll itself. Fuser rolls in common use have outer layers of a thickness on the order of 0.005–0.01 inches, while typical pressures exerted on the outer layer of a fuser roll are on the order of 50 to 150 psi.

It has been found that over an extended operating period, the copy material itself can cause excessive wear on certain portions of the fuser roll surface, most notably along the line where the relatively sharp edges of the copy material contact the fuser roll. The pressures associated with the fusing process create a stress line on the elastomeric layer along the edges of a sheet of copy material passing through the nip. When such stresses are repeated over thousands of sheets, a concentrated area of intense wear will result at each of the two points on the fuser roll corresponding to the edges of the sheets passing through. This problem is perhaps furthered by the tendency in the industry toward common sheet sizes, such as 11 inches. It is common among electrophotographic printers to feed 11-inch wide sheets through 14-inch wide rolls, because many designs preserve the option of feeding legal size (8.5" by 14") sheets through the fusing station in a long-edge feed manner. These areas of concentrated wear will clearly have a detrimental effect on the overall durability of the fuser roll.

U.S. Pat. No. 3,856,461 to Jordan, assigned to the assignee of the present application, discloses one proposed method for obviating the problems of wear on the fuser rolls. In this invention, one fuser roll is supported for limited axial displacement relative to the other roll. This axial movement of one fuser roll relative to the other serves to offset spot wear on the surface of the fuser rolls by spreading out the area along the axis of the fuser roll which comes in contact with an edge of a sheet of copy material passing through the nip. This invention, however, requires a relatively sophisticated movable roll bearing structure, which includes a bearing lock to retain the bearing structure and one of the fuser rolls in a selected axial position.

It as an object of the present invention to provide a method of feeding sheets of copy material through a nip formed by fuser rolls, which tends to reduce the wear on the fuser roll that is concentrated in discrete areas of the fuser roll.

It is another object of the present invention to provide such a method which does not necessarily require the addition of extensive ancillary equipment to an electrophotographic printing apparatus.

Other objects will appear hereinafter.

SUMMARY OF THE INVENTION

In accordance with the above objects, the present invention is a method for reducing wear on a movable fuser surface in an electrophotographic printing apparatus, where the fuser surface is adapted for the application of copy sheets thereon. The method comprises the step of applying each copy sheet onto the fuser surface so that at least one edge of the copy sheet is skewed relative to the direction of motion of the fuser surface.

In a preferred embodiment of the present invention, the fuser roll is adapted for cooperation with a second fuser roll, the fuser roll and the second fuser roll forming a nip therebetween for the passage of copy sheets therethrough. The method comprises the step of inserting each copy sheet through the nip so that at least one edge of the copy sheet is skewed relative to the direction of motion of the fuser roll.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
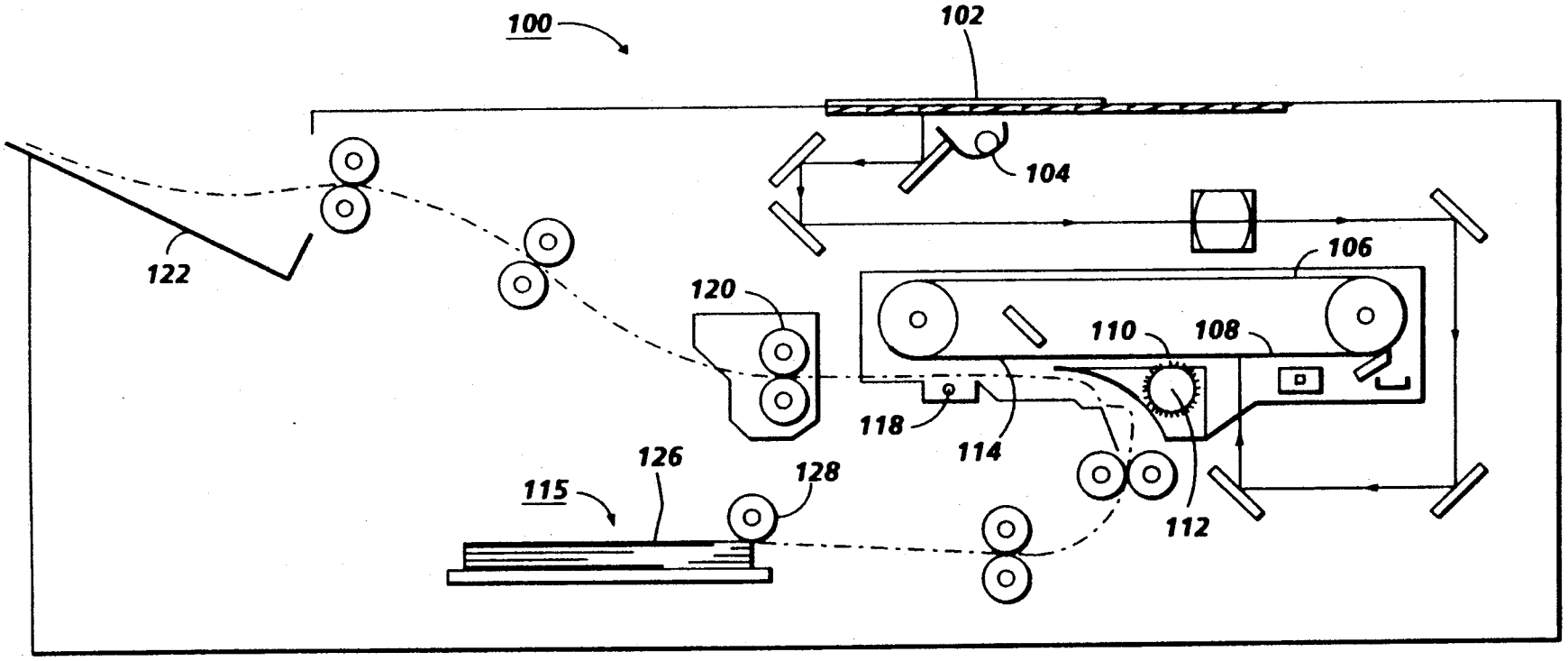
FIG. 1 PRIOR ART
FIG. 1 is a simplified cross-sectional view of an electrophotographic printer.

FIG. 1 shows the basic elements of a typical electrophotographic printer, in this case a photocopier 100. In photocopier 100, a document to be reproduced is placed on a platen 102 where it is illuminated in known manner by a light source such as a tungsten halogen lamp 104. The document thus exposed is imaged onto the photoreceptor belt 106 by a system of mirrors, as shown. The optical image selectively discharges the photoreceptor 106 in an image configuration whereby an electrostatic latent image of the original document is formed on the belt 106 at imaging station 108. The photoreceptor belt 106 then rotates so that the latent image is moved towards development station 110, where a magnetic brush developer system 112 develops the electrostatic latent image into visible form. At developer system 112, toner is dispensed from a hopper (not shown) and deposited in known manner, such as by magnetic brush development, on the charged area of photoreceptor belt 106 corresponding to the optical image to be reproduced.

The developed image is transferred at the transfer station 114 from the photoreceptor belt 106 to a sheet of copy paper, which is delivered from a paper supply system into contact with the belt 106 in synchronous relation to the image thereon. Individual sheets are introduced into the system from a stack of supply paper 126 by a friction feeder 128. A separated sheet from stack 126 is fed, in the embodiment shown, by further sets of nip roll pairs around a 180° path indicated by the broken line. At the transfer station 114, a transfer corotron 118 provides an electric field to assist in the transfer of the toner particles from the photoreceptor belt 106 to the copy sheet. The image is subsequently fused onto the paper in known manner at fusing station 120 and the finished copy is deposited in hopper 122.

Figure 2:
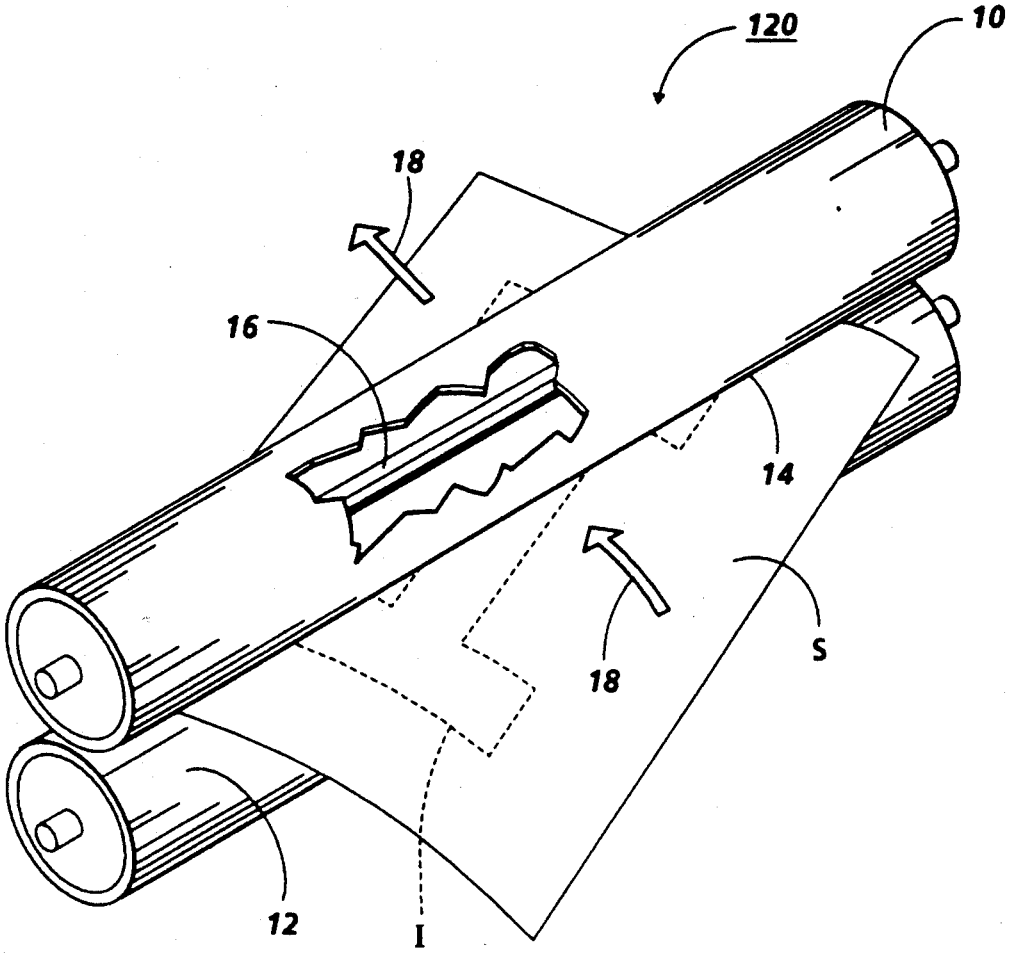
FIG. 2 is an elevational view of a fusing station incorporating the present invention.

FIG. 2 is a detailed elevational view of fusing station 120, which is of the hot-roll type, according to the present invention. The main elements of fusing station 120 are heat-pressure roll 10 and pressure roll 12. Either of these rolls shall be referred to herein, in the specification and claims, as a "fuser roll." The line of interface between the fuser rolls 10, 12 is indicated as nip 14. The heat-pressure roll 10 typically includes at its core a heat element 16, such as a quartz heat lamp, which provides heat to the outer surface of heat-pressure roll 10 when current is passed therethrough.

In a fusing operation, a sheet S bearing an image I is passed through the nip 14. The side of the sheet S bearing the image I faces the heat-pressure roll 10, so that the toner particles forming the image I will be exposed to the heat generated by heat element 16, while a normal force is exerted on the sheet S between heat-pressure roll 10 and pressure roll 12. As is familiar in the art, the combination of heat and pressure causes the toner particles in the image I to partially melt and thereby bond to the paper fibers in sheet S.

According to the present invention, as can be clearly seen in FIG. 2, the sheet S is introduced through the nip 14 in such a manner that the edges of the sheet S are skewed relative to the direction of motion, indicated by arrows 18, of the sheet S through nip 14. The direction of motion of a sheet S passing through nip 14 is perpendicular to the line of interface between fuser rolls 10, 12. As used in the present specification and claims, a "skew" is defined as an angular deviation, in the present case relative to the direction of motion of the sheet through the nip 14; to be "skewed" is to exhibit such a skew. This skewed arrangement of the substantially rectilinear sheet S reduces the wear on the surfaces of the fuser rolls 10, 12, in a manner which will be described below.

Figure 3A:
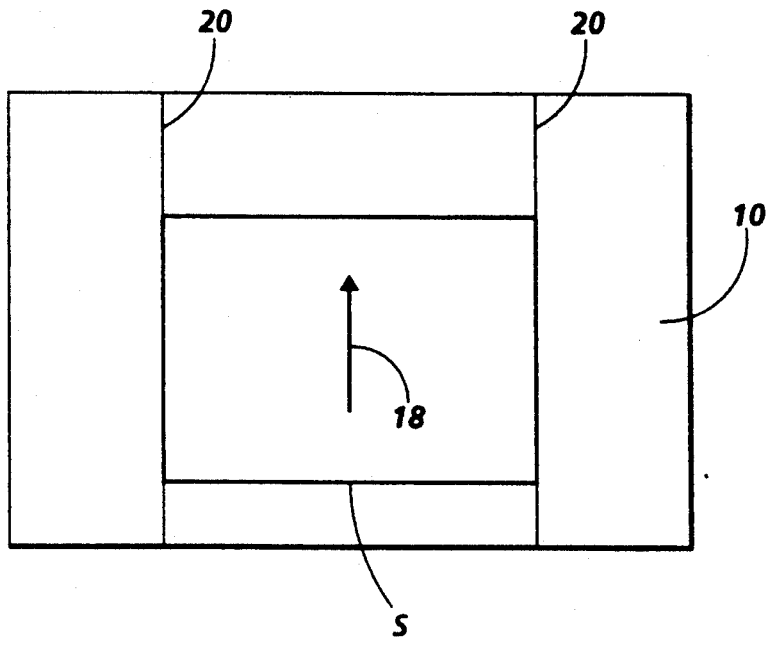
FIGS. 3A and 3B are comparative views showing the placement of a copy sheet on a fuser roll, in the prior art and according to the present invention, respectively.
Figure 3B:
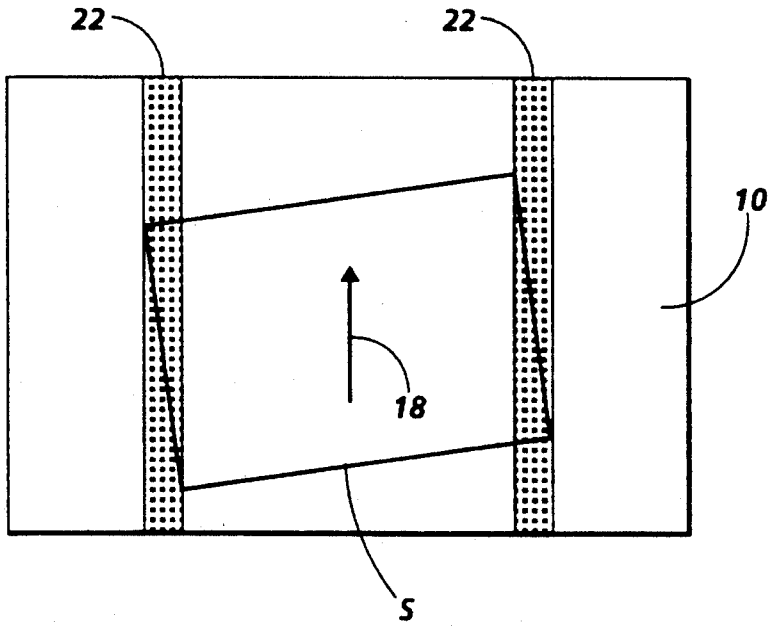

FIGS. 3A and 3B are comparative views of the interaction between the sheet S and the outer surface of one of the fuser rolls 10, first according to the prior art and then according to the present invention. In FIGS. 3A and 3B, the surface of one fuser roll 10 is "unrolled" to appear as a flat surface, upon which the outline of a sheet S is superimposed. FIG. 3A shows the prior art arrangement wherein the rectilinear sheet S moves in the direction of arrow 18 in such a manner that two of its edges are substantially parallel with the direction of motion. When a sheet S moves along the fuser roll 10, the high pressures exerted at the nip 14 between the fuser rolls 10, 12 create pinches on the surfaces of the fuser rolls 10, 12 at the edges of the sheet S, which in turn represent concentrations of wear at two discrete wear lines 20 around the circumference of the fuser roll 10. When thousands of copy sheets are passed through the nip 14, the continual pinching at the wear lines 20 will have a detrimental effect on the overall durability of the fuser roll 10.

FIG. 3B shows a skewed arrangement of a copy sheet S passing along the fuser roll 10, wherein the edges of the rectilinear sheet S are not parallel with the direction of motion indicated by arrow 18. The skew in the orientation of the sheet S causes the wear caused by the edges of the sheet S to spread out into relatively wide bands 22 along the axis of the fuser roll 10. Because the "density" of the wear on the surface of the fuser roll 10 in the wide bands 22 is much less than that of the narrow wear lines 20 of the prior art, the surface of the fuser roll 10 will, overall, wear out much less quickly. In this way, the skewed arrangement of sheets S in the present invention increases the life of the fuser roll.

In order to effect this skewed arrangement of inserting copy sheets into nip 14, several schemes are possible. A simple technique would be to provide a conventional electrophotographic printer, as shown in FIG. 1, and modify the position of the rolls in fusing station 120 so that the nip is skewed relative to a conventional paper path. In typical copiers and other electrophotographic printers, the sheets are applied to the photoreceptor belt 106 so that two edges of each sheet are substantially parallel with the direction of motion of the photoreceptor belt 106. In this way the nip 14 will be skewed relative to the path of a sheet S from the transfer station 114, which is in effect a continuation of the motion of the surface of photoreceptor belt 106 at transfer station 114.

However, there are attendant practical difficulties with skewing the nip of the fusing station relative to the path of a sheet off the photoreceptor. The skew of the nip will cause the sheet to change direction slightly, because the sheet must pass through the nip in a direction perpendicular to the nip; i.e., the sheet must move with the outer surfaces of the fuser rolls. This change of direction is likely to cause smearing, crumpling, or jamming if one portion of a sheet begins passing through the fusing station while another portion of the sheet is still in contact with the photoreceptor, as different portions of the same sheet will be moving in deviating directions. Thus, for such a system to work at all, a sheet may not begin to enter a skewed fusing station until substantially all of the sheet has cleared the photoreceptor. The necessity of clearing the photoreceptor has the effect of lengthening the total paper path in the machine, and the travel from the photoreceptor to the fusing station of a copy sheet with unfused toner thereon will present further paper-handling difficulties.

In the preferred embodiment of the present invention, the skewed arrangement of sheets relative to the direction of motion of the sheets through the entire system is an inherent property of the entire apparatus. For example, in a light-lens copier the skew could be accomplished by skewing the platen glass registration edge and the paper transports relative to the photoreceptor belt 106. In an electrophotographic printer, the electronic subsystem and imaging system could be designed to electronically skew the image projected onto the photoreceptor 106. The image skew may also be obtained by skewing the mirrors in the light-lens optics or in the design or placement of a read output scanner (ROS) unit without affecting the platen area. If it is to be intended that the skew of copy sheets and corresponding skew in the images placed thereon will be an inherent part of the design of the entire apparatus, the necessary skew is determined by the minimum allowable wear areas 22 on fuser rolls 10, 12 that would not adversely affect system performance.

Figure 4:
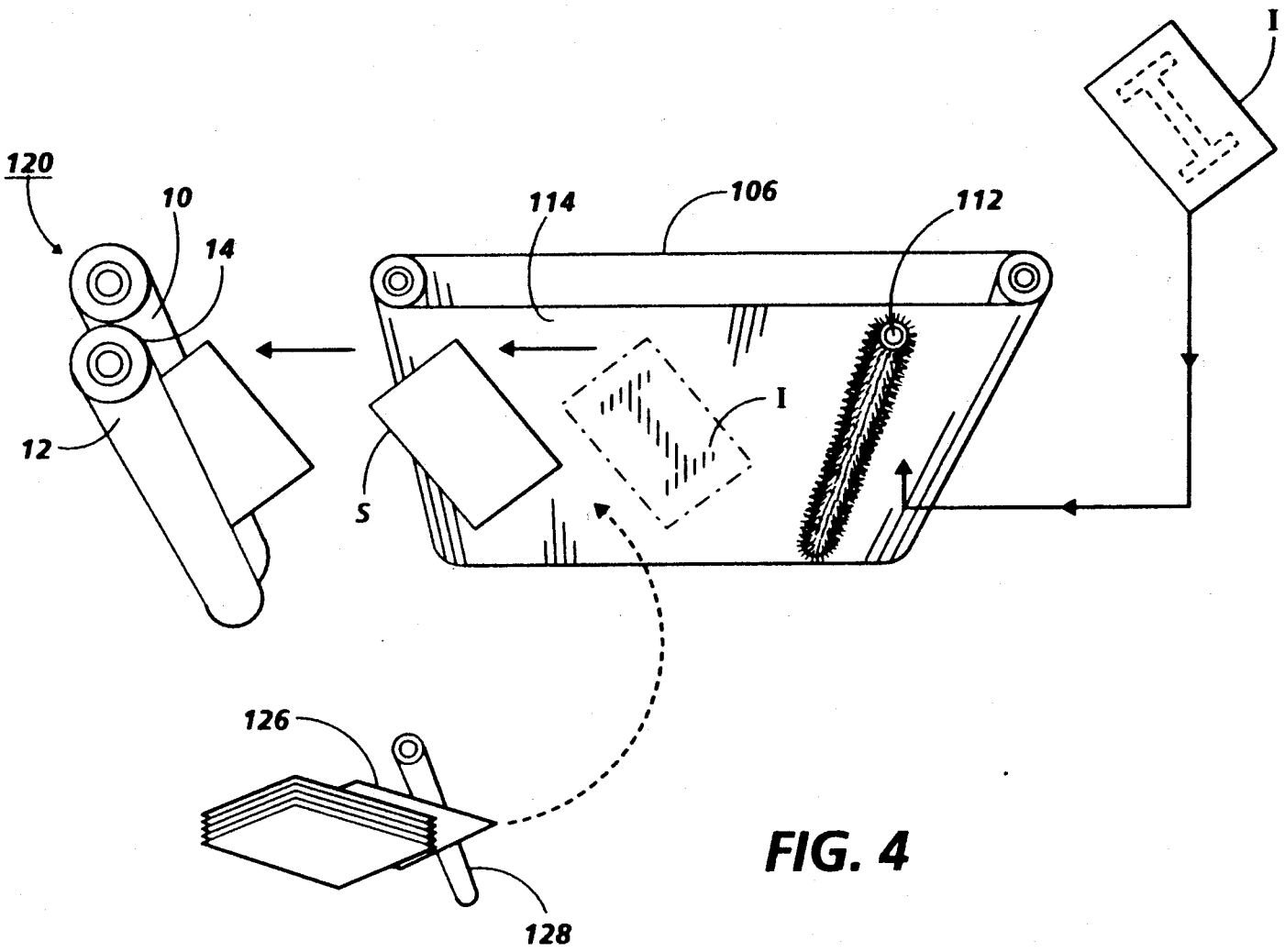
FIG. 4 is a simplified perspective view of an electrophotographic printer incorporating the present invention.

FIG. 4 is a simplified perspective view of an electrophotographic printer, having the same elements as shown in FIG. 1, wherein the skewed arrangement of the present invention is inherent in the design of the entire system. As can be seen, the image I, whether from a ROS or from a document on a platen, is created on the photoreceptor belt 106 so that the edges thereof are skewed relative to the direction of motion of photoreceptor belt 106. Similarly, the copy sheets from stack 126 are skewed relative to their path of motion (shown by the dotted line) so that the sheets will have the same skew as the image I at transfer station 114. The skewed sheet S is then passed through the nip 14 of fuser station 120, which is arranged perpendicular to the direction of motion, as opposed to the orientation of the edges, of the sheet.

Another possible arrangement for carrying out the present invention is to add an auxiliary device within the electrophotographic printer to impart a skew to a copy sheet at a point between the transfer station and the fusing station. U.S. Pat. No. 4,971,304 to Lofthus, assigned to the assignee of the present invention, describes one possible arrangement which may be adapted to impart such a deliberate skew before the fusing station. This patent as a whole teaches a technique for correcting (i.e., removing) a skew from a sheet moving through a system. Although skews are corrected in the prior art generally by imparting a counteracting skew, this patent does not suggest that the apparatus described therein can be used for deliberately causing a skew. However, it should also be mentioned that the use of additional drive rollers to deliberately impart a skew to a copy sheet going into the nip is likely to cause contact with unfused toner on the copy sheet, which will result in streaking and other copy defects.

Although the embodiments described herein relate to skewing of copy sheets passing through a nip formed by a fuser roll and a second roll, it is clear that the general principle of applying such a deliberate skew to a sheet, with its attendant advantages, can be applied to any number of situations within an electrophotographic printer or any sheet-feeding apparatus. The invention need not be limited to fuser rolls per se, but may be applied to reduce wear on and increase the life of any surface on which sheets are applied with appreciable force, such as the nip rolls which convey individual sheets from the supply 126 to the photoreceptor 106 in the apparatus illustrated.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A method for reducing wear on a fuser roll rotatable around an axis in an electrophotographic printing apparatus, the fuser roll being adapted for cooperation with a pressure roll rotatable around a longitudinal axis parallel to the axis of the fuser roll, the fuser roll and the pressure roll being in contact with each other and forming a nip therebetween, comprising the step of inserting a copy sheet through the nip so that at least one edge of the sheet is skewed relative to a direction of motion, perpendicular to the axes of the fuser roll and pressure roll, of the sheet through the nip.

2. An electrophotographic printing apparatus, comprising:

a photoreceptor surface, adapted for the creation of electrostatic latent images thereon, movable in a direction of motion;

imaging means for creating an electrostatic latent image on the photoreceptor;

developing means for applying to a latent electrostatic image on the photoreceptor a developer material;

transfer means for transferring the developer material corresponding to the latent image on the photoreceptor onto a sheet including means for moving the sheet in the direction of motion of the photoreceptor surface as the sheet is applied to the photoreceptor surface; and fusing means for fixing the developer material onto the sheet, the fusing means including two fuser rolls, each fuser roll being rotatable around an axis, the axes of the fuser rolls being substantially parallel to each other, the fuser rolls forming a nip therebetween, the nip allowing passage of a sheet from the photoreceptor surface therethrough in a direction of motion perpendicular to the axes of the fuser rolls as the fuser rolls rotate in cooperation with each other;

wherein the imaging means is adapted to create an electrostatic image on the photoreceptor surface in a skewed fashion relative to the direction of motion of the photoreceptor surface, and the transfer means is adapted to apply the sheet to the photoreceptor surface in a correspondingly skewed fashion, so that at least one edge of the sheet is skewed relative to the direction of motion of the sheet through the nip of the fusing means.

* * * * *